US005977499A

United States Patent [19]

Black et al.

[11] Patent Number: 5,977,499

[45] Date of Patent: Nov. 2, 1999

[54] SLIDE SELECTOR SWITCH

[75] Inventors: Richard L. Black, Granger; Kevin D. Kurtz, Fort Wayne; John Zdanys, Elkhart, all of Ind.

[73] Assignee: CTS Corporation, Elkhart, Ind.

[21] Appl. No.: 09/061,527

[22] Filed: Apr. 16, 1998

[51] Int. Cl.[6] ..... H01H 9/02; H01H 15/00

[52] U.S. Cl. ..... 200/303; 200/16 D

[58] Field of Search ..... 200/16 R, 16 B, 200/16 C, 16 D, 16 E, 16 F, 303, 537–552, 292

[56] References Cited

U.S. PATENT DOCUMENTS

| | | | |
|---|---|---|---|
| 2,246,373 | 6/1941 | Lodge | 200/16 C |
| 2,356,521 | 8/1944 | Kochner | 200/550 |
| 3,226,515 | 12/1965 | Concelman | 200/16 C X |
| 3,330,930 | 7/1967 | Hill et al. | 200/252 |
| 3,412,225 | 11/1968 | Rogers et al. | 200/303 X |
| 3,461,252 | 8/1969 | Vananzi | 200/16 C |
| 3,462,564 | 8/1969 | Bedocs | 200/16 C |
| 3,632,909 | 1/1972 | rowley | 200/16 D |
| 3,663,780 | 5/1972 | Golbeck | 200/314 |
| 3,737,594 | 6/1973 | Rosmanith | 200/16 R |
| 3,739,126 | 6/1973 | Sahrbacker et al. | 200/16 C X |
| 3,745,270 | 7/1973 | Granitz | 200/16 C |
| 3,781,866 | 12/1973 | Kilby | 200/16 C X |
| 3,787,653 | 1/1974 | Maher | 200/275 X |
| 3,857,000 | 12/1974 | Boulanger | 200/16 D |
| 3,857,008 | 12/1974 | Van Der Donk | 200/16 D X |
| 4,137,440 | 1/1979 | Bryant | 200/16 B X |
| 4,172,972 | 10/1979 | Sykora et al. | 200/16 D X |
| 4,186,288 | 1/1980 | Overton et al. | 200/16 D X |
| 4,204,104 | 5/1980 | Quigley | 200/550 |
| 4,307,268 | 12/1981 | Harper | 200/275 X |
| 4,314,112 | 2/1982 | Mission et al. | 200/275 X |
| 4,341,935 | 7/1982 | Josemans | 200/252 |
| 4,491,703 | 1/1985 | Jaklic | 200/16 D |
| 4,506,119 | 3/1985 | Tanabe | 200/16 C |
| 4,599,496 | 7/1986 | Lecklider | 200/1 B |
| 4,668,849 | 5/1987 | Sasaki et al. | 200/16 C X |
| 4,710,600 | 12/1987 | Sasaki et al. | 200/16 C X |
| 4,737,602 | 4/1988 | Yamamoto | 200/16 D |
| 4,922,063 | 5/1990 | Shimizu et al. | 200/16 D X |
| 5,191,971 | 3/1993 | Hakkarainen et al. | 200/550 |
| 5,315,079 | 5/1994 | Gierut | 200/16 D |
| 5,544,274 | 8/1996 | Walker et al. | 200/252 X |
| 5,587,886 | 12/1996 | Lan | 361/781 |
| 5,672,854 | 9/1997 | NIshio | 200/16 R |

*Primary Examiner*—J. R. Scott
*Attorney, Agent, or Firm*—Mark P. Bourgeois

[57] ABSTRACT

A linear slide selector switch for multiple channels for selecting between several switch positions. Specifically, there is a housing having a hinged door with a latch lock, the door rotates to a closed position and is held in a closed position by the latch lock. The housing also contains a slide and a printed circuit board. The printed circuit board has rows of contacts. A contactor is mounted to the slide. As the slide is moved linearly, electrical connections are made and broken on the printed circuit board.

8 Claims, 4 Drawing Sheets

SLIDE SELECTOR SWITCH

BACKGROUND OF THE PREFERRED EMBODIMENT(S)

1. FIELD OF THE PREFERRED EMBODIMENT(S)

This invention generally relates to a linear slide selector switch for multiple channels for selecting between several switch positions. Specifically, there is a housing that contains a slide and a printed circuit board. The printed circuit board has rows of contacts. A contactor is mounted to the slide. As the slide is moved linearly, electrical connections are made and broken on the printed circuit board.

2. DESCRIPTION OF THE RELATED ART

Various devices are well known for selecting between several switch positions such as rotary switches, encoders, push button switches, linearly actuated switches, etc.

Rotary switches to control more than one channel through several switch positions are fabricated by adding additional rotary switch/leadframe assemblies to a single rotary actuator. Push button switches are generally limited to the actuation of switch positions for one channel. Linearly actuated switches currently exist for switching between several positions for only one channel.

Multi-position, multiple channel switches are commonly utilized in volume controls for in-wall building stereo systems. Typically, there is a rotary switch mounted on a printed circuit board that has components mounted thereon including two multi-tap inductors or transformers.

Despite the prior art devices, none have allowed the user to control several switch positions over more than one channel with a single linear actuator.

DESCRIPTION OF RELATED ART

Examples of patents related to the present invention are as follows, wherein each patent is herein incorporated by reference for related and supporting teachings:

U.S. Pat. No. 5,191,971, is a multi-position wall mountable control switch with tactile feedback linear actuator.

U.S. Pat. No. 4,710,600, is a detent mechanism for sliding electric parts.

U.S. Pat. No. 4,668,849, is a detent mechanism for sliding electric parts.

U.S. Pat. No. 4,491,703, is a detenting and contact registration system for a linear DIP switch.

U.S. Pat. No. 3,781,866, is a binary encoding switch.

U.S. Pat. No. 3,632,909, is a slide selector matrix keyboard switch assembly with improved contact structure.

U.S. Pat. No. 3,461,252 is a multiposition slide switch.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

PROBLEMS WITH THE PRIOR ART

There are several problems that exist with the prior art that are addressed by the preferred embodiment. One problem occurs when rotary switches are used to control more than one channel through several switch positions. This is accomplished by adding additional rotary switch/leadframe assemblies for each channel to a single rotary actuator. As the number of channels increases, the switch becomes large in terms of size and expensive in terms of cost to fabricate. The large size is a particular problem when it is desired to mount the switch on a printed circuit board as the switch takes up space that could be utilized to mount other components and adds to the cost of the assembly.

Another problem is that linearly actuated switches currently exist for switching between several positions for only one channel. If it is desired to control several channels simultaneously, as for example, the two audio channels in a stereo system, then two separate manual actuators and switch assemblies must be furnished and installed. This leads to an increased cost and is not as aesthetically pleasing as having a single actuator.

Another problem is that many switch positions are needed and linear switches typically require a long length to provide the number of positions. Those typical linear switches would not work in an application where the amount of length or space is limited.

Another problem is that the linear switch must be compact in design, easy to assemble and use inexpensive parts.

This and other problems will be solved by the preferred embodiments of the invention. A review of the specification, drawings, and claims will more clearly teach a skilled artisan of other problems that are solved by the preferred embodiments.

SUMMARY OF THE PREFERRED EMBODIMENT(S)

It is a feature of the invention to provide a sliding switch apparatus for multiple channels for selecting from a multiple of switch positions for each channel. Specifically, there is a housing with a slot and a slide located within the housing. A manual actuator extends through the slot. A printed circuit board is attached to the housing and has several rows of switch contacts. A contactor is attached to the slide and is located between the slide and each row of switch contacts. The contactor operates as the manual actuator and the slide is moved to make and break electrical connections between the switch contacts.

It is a feature of the invention to provide a linearly actuated selector switch with a multiplicity of electrical positions in a cost effective design in a compact size.

A further feature of the invention is to provide a one piece housing for the slide selector switch having a hinged door and locking tabs to hold the door closed.

Another feature of the invention is to provide a detent means attached to said slide and to said housing, said detent means operable to provide a positive mechanical stop for each of said switch positions.

Another feature of the invention is to provide an insulative material on the printed circuit board and between the switch contacts such that a height differential between the switch contacts and the printed circuit board is minimized.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other features of the invention can best be understood by the following description of the accompanying drawings as follows.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DETAILED DESCRIPTION OF THE PREFERRED EMBODIMENT

Figure 1:
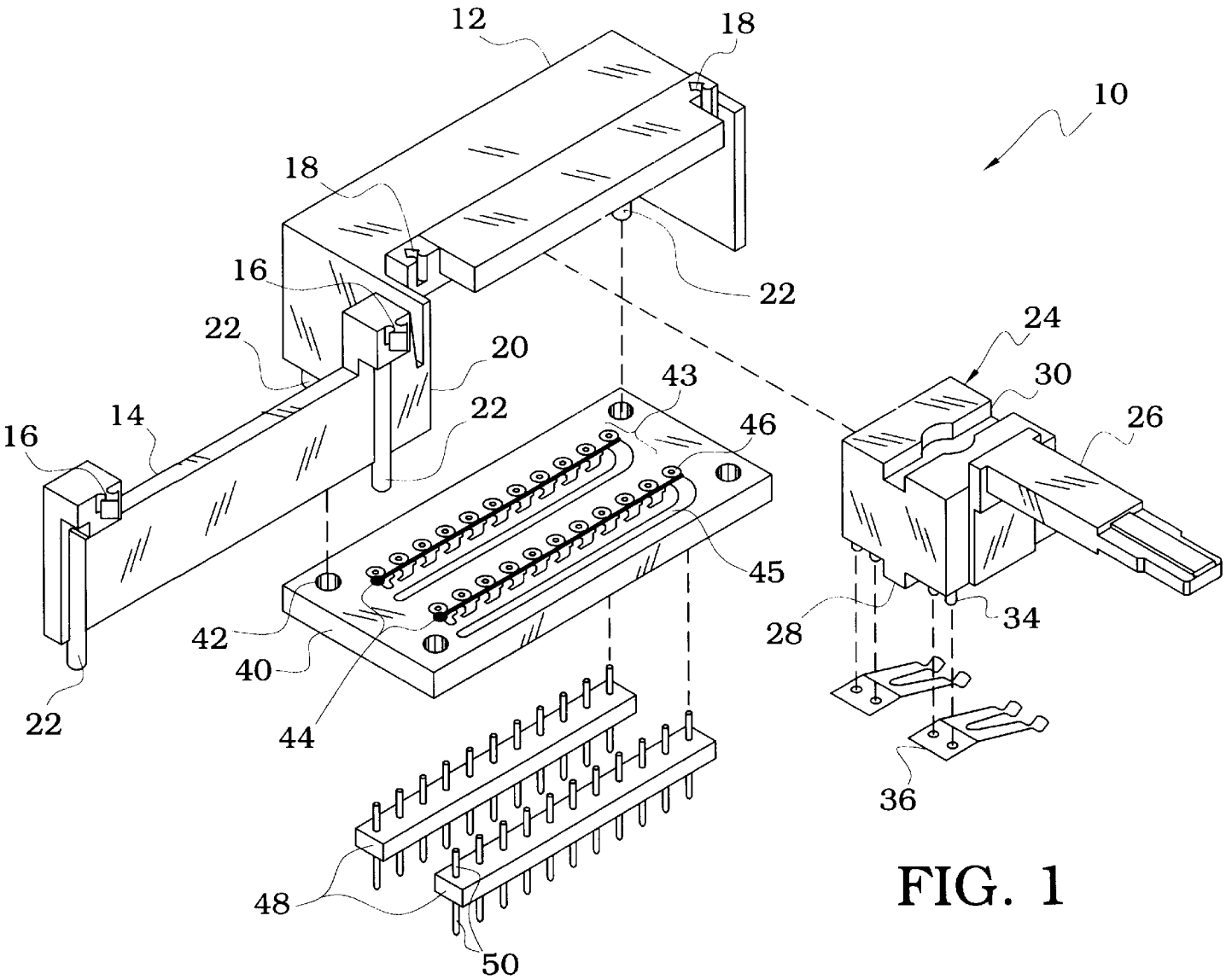
FIG. 1 is an exploded perspective view of the preferred embodiment.
Figure 2:
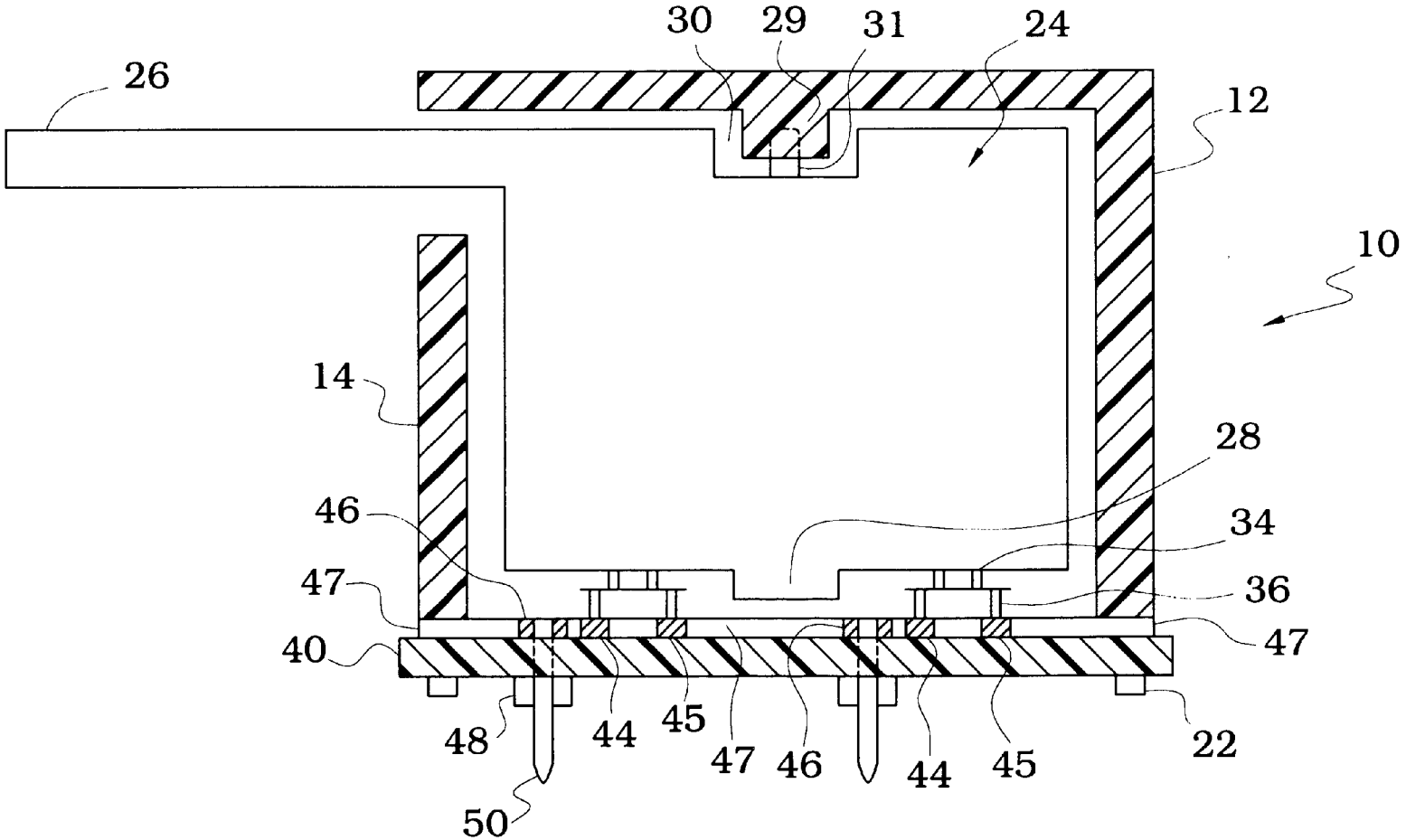
FIG. 2 is a cross-sectional side view of FIG. 1 in its assembled condition.

Referring to FIGS. 1 and 2, there is an exploded perspective view and a cross-sectional side view of the assembled switch, respectively of the preferred embodiment of the invention. Specifically, there is slide selector switch assembly 10. The switch 10 has a generally rectangular housing 12 for containing the switch assembly 10. The housing 12 has a door 14 swingably connected to the housing by a hinge 20. The door 14 is integrally molded with the housing 12. The door has two latch lock tabs 16 integrally mounted on each end of the door 14. The housing has two latch lock receptacles 18 integrally mounted on each end of the housing 12. The latch lock tabs 16 cooperate with the latch lock receptacles 18 when the door is closed after assembly of the switch assembly 10 to lock the door 14 closed. The housing 12 and the door 14 each have a pair of cylindrical printed circuit board holding pins 22 protruding therefrom. The pins 22 are located on the ends of the door 14 and the housing 12. The housing 12 and door 20 are preferably molded out of plastic in a single piece in a single cavity mold.

Figure 3:
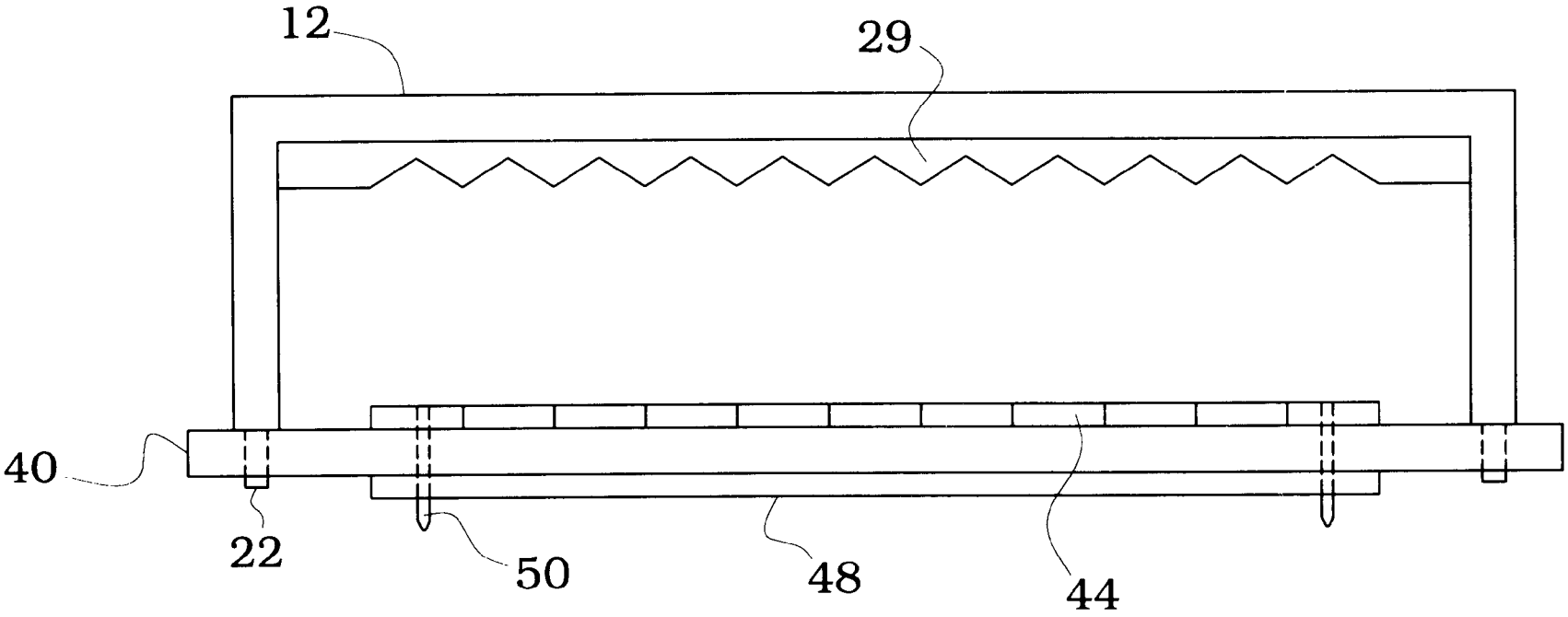
FIG. 3 is a front view of FIG. 2 with the door and slide removed.

A slide or actuator 24 has a slide handle 26 extending therefrom for manually moving the slide 24. A rail 28 protrudes from a bottom side of the slide 24. The rail 28 supports the slide 24 as it is moved. The slide also has a detent slot 30 and a detent 31. The detent 31 is typically made in the shape of a ball or bullet head. The detent 31 is biased upwards by a spring (not shown). The housing 12 has a detent rail 29 attached to the inside top surface of the housing 12 (best seen in FIG. 3). The detent rail 29 has a sawtooth shape. The detent 31 moves into and out of engagement with the detent rail 29 as the slide 24 is moved which provides the user with a tactile mechanical feedback of the switch assembly 10 position. The slide 24 also has two pair of cylindrical contactor holding pins 34 protruding downwardly on opposite sides of the rail 28. The holding pins 34 mount and hold metallic contactors 36. The metallic contactors 36 can be formed by chemical etching or by mechanical stamping or pressing. The slide 34 is preferably molded out of a single piece of plastic.

A rectangular printed circuit board 40 has four mounting holes 42 located at each corner. The printed circuit board 40 has on a top surface two switch tracks 43 that are each made of a row of switch contacts 44, a row of conductor lines 45 and a row of plated through holes 46. There are two rows of pin holders 48 that contain pins 50. The pins 50 are inserted through the plated through holes 48 and soldered into place. The pins 50 make an electrical connection between the printed circuit board 40 and another printed circuit board (not shown) on which the switch assembly 10 is mounted.

Figure 4:
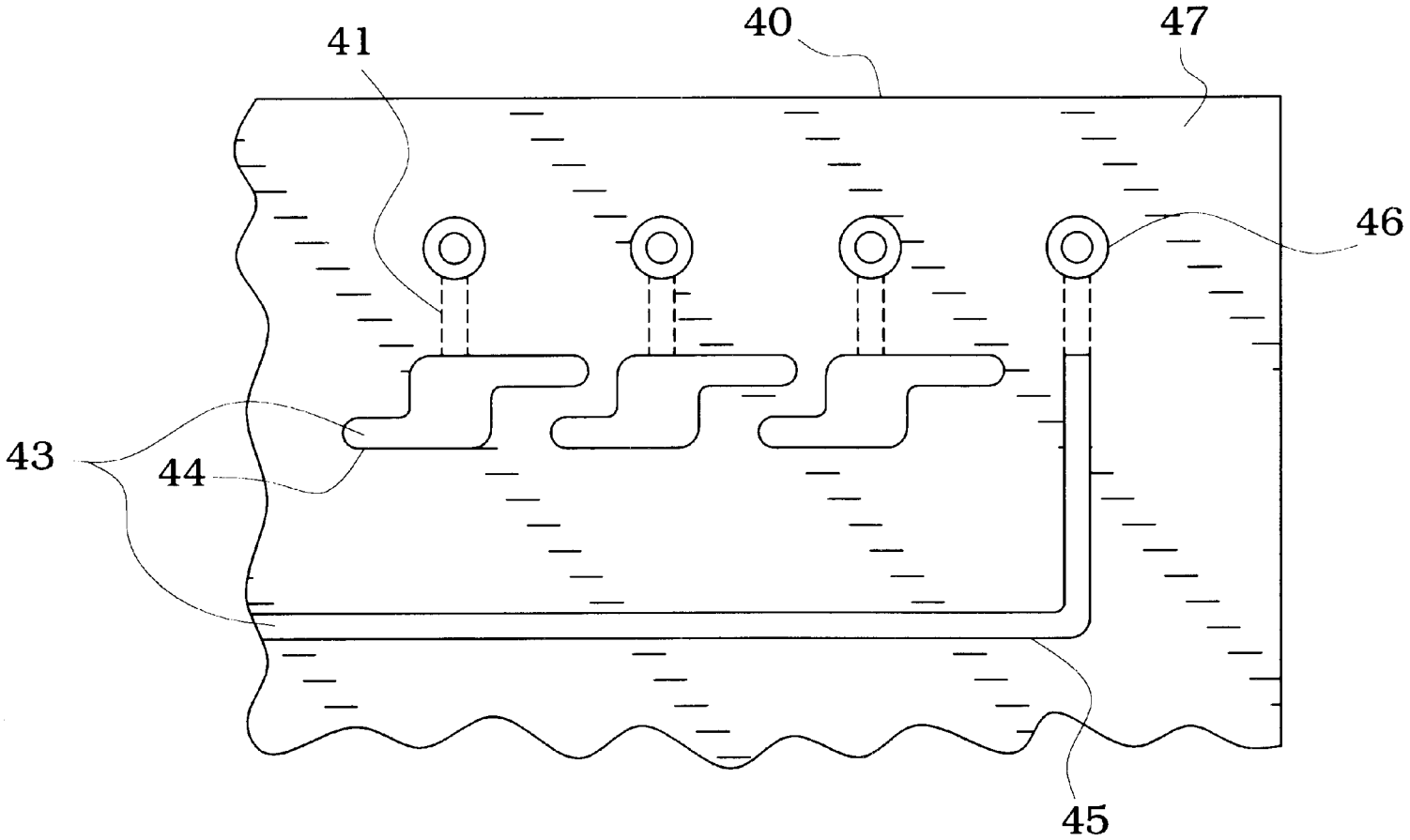
FIG. 4 shows a portion of the switch contacts on the printed circuit board.

Referring to FIG. 4, there is shown a portion of the printed circuit board 40. The printed circuit board 40 has on a top surface, copper switch contacts or pads 44, copper conductor line 45 and copper plated through holes 46. A switch contact to through hole copper connection line 41 is shown connecting the switch contacts 44 to the plated through holes 46. A printed circuit board solder mask or insulative material 47 is shown covering the surface of the printed circuit board 40 every where except on the switch contacts 44, the conductor line 45 and the plated through holes 42. The solder mask 47 is a commercially available solder mask such as Chemask W available from Chemtronics Corporation of Kennesaw, Ga. 30152. The solder mask 47 makes the overall surface of the printed circuit board 40 smoother and specifically provides for a smooth movement of the slide 24 and contactors 36 over the switch contacts 44 by making the surface of the solder mask 47 the same height as the switch contacts 44 and conductor lines 45. Additionally, the solder mask 47 acts as a solder dam when soldering pins 50 into plated through holes 46. Thus, preventing solder from wicking into the switch contacts 44 and conductor lines 45.

The switch selector assembly 10 is assembled as follows: The first step is to place the contactors 36 onto the contactor pins 34 and to affix the contactors in place by heating the plastic contactor pins 34. As the pins 34 are heated, the plastic on the end melts and increases in diameter holding the contactors 36 in place. The second step is to place the detent 31 into the slide 24. The third step is to place the slide 24 into the housing 12. The fourth step is to close the door 14 onto the housing 12 such that the latch lock tabs 16 mate with the latch lock receptacles 18 to hold the door 14 closed. The fifth step is to insert pin holders 48 and pins 50 into the plated through holes 46 and solder the pins 50 in place. The sixth and final step is to place the printed circuit board 40 onto the printed circuit board holding pins 22 and to affix the printed circuit board 40 in place by heating the plastic contactor pins 34. As the pins 22 are heated, the plastic on the end melts and increases in diameter holding the printed circuit board 40 in place.

The operation of the slide selector switch 10 is described next. The slide handle 26 is grasped by the hand of the operator and moved. As the slide handle 26 moves, the slide 24 moves and likewise the two contactors 36 slide over the switch contacts 44 and the conductor line 45. The contactors 36 serve to short each switch contact 44 to the conductor line 45 and complete an electrical connection. As the slide 24 is moved to the next position, the next switch contact 34 in the row is connected to the conductor line 45.

REMARKS ABOUT THE PREFERRED EMBODIMENT

One of ordinary skill in the arts of switches, and more particularly the art of designing selector switches, will realize many advantages from using the preferred embodiment. In particular, the slide selector switch allows the switching of multiple channels using a single linear actuator. Specifically, note that both rows or channels of contacts 34 are electrically connected and electrically disconnected simultaneously. As the slide 24 is moved, the detent 31 moves into and out of the sawtooth pattern of the detent rail 29 providing a tactile mechanical feedback to the user as to the position of the selector switch.

Additionally, a skilled artisan will understand that the slide selector switch can be fabricated in a small size and has a small footprint when it is mounted on a printed circuit board. Each new channel being added will only increase the width of the housing 12 by 0.30 inches which is the space needed for contacts 44 and conductor lines 45.

It is further noted that a skilled artisan would realize that the slide selector switch 10 is capable of being economically manufactured. Specifically, the use of a printed circuit board made 40 out of FR4 material for the base of the switch assembly 10 housing, and for mounting the switch contacts 44 and the conductor lines 45 is very cost effective. Especially, because many printed circuit boards 40 can be fabricated at the same time on a large printed circuit panel.

A skilled artisan will also realize that the chosen shape of the switch contact pads 44 are designed to provide many switching positions in a very short length. Specifically, the switch contact 44 pattern shown in FIG. 4 is designed to be a make before break switching pattern. In a make before break switching pattern, the next switch position contact is made prior to breaking the last switch position contact.

VARIATIONS OF THE PREFERRED EMBODIMENT(S)

One of ordinary skill in the art of making switches will realize that there are many different ways of accomplishing the preferred embodiment. For example, it is contemplated to make the housing 12, door 14, and slide 24 out of any suitable material, like plastics, epoxy resin, fiberglass etc. Additionally, the door could be fastened closed by other methods such as glue or screws, or mechanical fasteners. The door could also be designed to be any surface of the housing 12. For example, the top, side or back could be hinged open and could be closed in a similar manner.

Even though, the embodiment discusses the use of two contactors 36 and two rows of switch contacts 44, it is contemplated to use three or four or more rows of contactors 36 and switch contacts 44. Similarly, less rows could be utilized.

Similarly, even though the embodiment discusses the use of a printed circuit board 40 to mount the contacts 44, one skilled in the art of electronic packaging would realize that a ceramic material or a flexible circuit substrate material could also be used. It is also possible to make electrical connections to the plated through holes 46 by other than soldering, for example press-fit connectors or some type of surface mount connectors could be used.

Although, the slide selector switch 10 is illustrated as having a detent 31, it is contemplated to omit the detent 31, the detent slot 30 and the detent rail 29 and provide no mechanical feedback to the user.

Additionally, although it is illustrated that the slide 24 has generally rectangular shape, it is contemplated to form the slide in a variety of shapes such as square, oval, round etc.

Even though it is taught to place the printed circuit board 40 on the bottom of the housing 12, it is contemplated to place it on the back side that is opposite to the handle 26. This would also move the switch contacts 44 accordingly. Moreover, the same result occurs by moving the printed circuit board 40 to the top side of the housing 12.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A sliding switch apparatus for selecting a plurality of switch positions, comprising:

a) a one piece molded housing having a hinged door with at least one latch lock, said door operable to rotate to a closed position and be held in said closed position by said latch lock;

b) a slide disposed within said housing;

c) a printed circuit board attached to said housing and having at least one row of switch contacts disposed thereon, said printed circuit board having a plurality of terminal pins attached to said printed circuit board switch contacts; and d) at least one contactor attached to said slide and disposed between said slide and said switch contacts, said contactor operable as said slide is moved to make and break electrical connections between said switch contacts.

2. The apparatus of claim 1, further comprising:

detent means attached to said slide and to said housing, said detent means operable to provide a positive mechanical stop for each of said switch positions.

3. The apparatus of claim 1, wherein said printed circuit board has an insulative material disposed thereon between said switch contacts such that a height differential between said switch contacts and said printed circuit board is minimized.

4. A sliding switch apparatus for at least one channel for selecting a plurality of switch positions for each channel, comprising:

a) a one piece molded housing having a hinged door with at least one latch lock, said door operable to rotate to a closed position and be held in said closed position by said latch lock;

b) a printed circuit board attached to said housing and having a row of adjacent switch contacts disposed thereon, said printed circuit board having a plurality of terminal pins attached to said printed circuit board switch contacts; and c) a slide disposed within said housing and having a contactor attached to said slide to make electrical and mechanical engagement with said row of switch contacts such that as said slide is moved, said contactor makes and breaks electrical connections between said switch contacts.

5. The apparatus of claim 4, further comprising:

detent means attached to said slide and to said housing, said detent means operable to provide a positive mechanical stop for each of said switch positions.

6. The apparatus of claim 4, wherein said printed circuit board has an insulative material disposed thereon between said switch contacts such that a height differential between said switch contacts and said printed circuit board is minimized.

7. A sliding switch apparatus for selecting a plurality of switch positions for at least one channel, comprising:

a) a housing having a slot and a hinged door;

b) a slide disposed within said housing and having a manual actuator extending through said slot;

c) a printed circuit board attached to said housing and having a plurality of rows of switch contacts disposed thereon; and d) contact means attached to said slide and disposed between said slide and each said row of switch contacts, said contact means operable as said manual actuator and said slide is moved to make electrical connections between said switch contacts when said slide is in a first position and to break electrical connections between said switch contacts when said slide is in a second position, said switch contacts completing electrical connection in said first position before breaking electrical connection in said second position.

8. The slide switch according to claim 7, wherein the switch contacts are generally z shaped.

* * * * *